United States Patent [19]

Rowell

[11] Patent Number: 4,495,748

[45] Date of Patent: Jan. 29, 1985

[54] CONTAINERS AND MACHINE FOR MAKING THEM

[76] Inventor: Frank J. Rowell, Fishponds Farm, Brook, Near Ashford, Kent, England

[21] Appl. No.: 309,746

[22] Filed: Oct. 8, 1981

[30] Foreign Application Priority Data

Oct. 14, 1980 [GB] United Kingdom ..... 8033091
Jul. 31, 1981 [GB] United Kingdom ..... 8123457

[51] Int. Cl.[3] ..... B65B 9/12; B65B 3/16; B65B 3/17

[52] U.S. Cl. ..... 53/449; 53/451; 53/474; 53/170; 53/552; 53/554; 493/294; 493/302; 493/929; 493/931

[58] Field of Search ..... 53/451, 449, 474, 170, 53/172, 554, 555, 552; 493/294, 297, 302, 217, 213, 929, 931, 933

[56] References Cited

U.S. PATENT DOCUMENTS

| | | | |
|---|---|---|---|
| 2,154,521 | 4/1939 | Maxfield | 53/451 X |
| 3,391,047 | 7/1968 | Kopp | 53/554 X |
| 3,479,802 | 11/1969 | Fesco | 493/213 X |
| 3,795,081 | 3/1974 | Brown, Jr. et al. | 53/474 X |
| 3,889,446 | 6/1975 | Simmons et al. | 53/449 X |

*Primary Examiner*—Horace M. Culver
*Attorney, Agent, or Firm*—Murray, Whisenhunt and Ferguson

[57] ABSTRACT

The invention provides a container preferably made from sheet plastics comprising a bag containing a tubular valve member, the bag being sealed with a seam at each end, the top seal having an opening therein for entry of an access tube into the valve member, and the valve member having a sealing seam which facilitates piercing of the access tube through the valve member into the bag. A second bag may be provided within the first bag.

The invention includes a machine for making the containers continuously from sheets of material.

8 Claims, 17 Drawing Figures

CONTAINERS AND MACHINE FOR MAKING THEM

BACKGROUND OF THE INVENTION

This invention relates to containers of the kind made from liquid-impervious flexible material especially from flexible plastics sheet.

STATEMENT OF PRIOR ART

Many constructions of plastics containers are known having many uses. Problems arise where there is a requirement for opening the container for the purpose of dispensing the contents in a satisfactory manner without spillage. Access to cartons containing drinks is often made difficult if the container cannot be satisfactorily punctured by the drinking straw provided. Alternatively, entry of the straw causes some, if not an unacceptable amount, of the contents to emerge around the aperture formed by the straw. This problem has been solved by the provision of a removable or tear-off tab which exposes a hole for entry of the straw. Whilst this facilitates access to the contents, the manufacturing processes involved are cumbersome and expensive.

Further problems arise if re-sealing is required while still retaining some of the contents. It is frequently experienced that a plastics container once punctured is difficult if not impossible to re-seal. Provision is often made for opening the carton by cutting off a corner thereof. No re-sealing is possible here and furthermore difficulty is often experienced in pouring.

OBJECT OF THE INVENTION

An object of the present invention is therefore to provide a container made of liquid-impervious flexible sheet material which is cheap to manufacture and constructed in such a manner as to afford easy access to the contents. A further object is to provide means for effective re-sealing to conserve the remainder of the contents after initial use.

Another object is to provide an improved container adapted to contain two materials to be mixed within the container.

The container is particularly adapted for use with liquids suh as water, oil or various beverages but may equally well be used for containing more viscous or pasty materials such as bituminous substances, glue, foods (such as ketchup and salad cream), tiling cement, toothpaste, grease or any material which exhibits the characteristic of liquid flow.

SUMMARY OF THE INVENTION

According to the invention there is provided a method and machine for making container comprising a bag, and a tubular valve member disposed within said bag, both bag and valve member being made of liquid-impervious flexible sheet material, a first bag sealing seam across one end of said bag and valve member, a second bag sealing seam across the other end of said bag and valve member, valve member sealing seam between said first and second bag sealing seams, said first bag sealing the layers of the bag and valve member together save for an opening through said first bag sealing seam thereby providing entrance from the exterior of the container to the interior of the valve member within the bag.

The valve member seam ensures that the access tube will meet the resistance of this tube and pierce the valve member. The bag may carry printed instructions for insertion of the access tube towards the valve member seam. The valve member seam may extend partly or wholly across the valve member.

Liquid within the container, which is introduced into the container during manufacture of the latter, cannot escape through the sealed aperture in the valve member until the user has inserted an access tube through the opening and has broken through the valve member. On removal of the access tube, after partially emptying the container, the valve member is closed by pressure of the remaining liquid against the sides of the valve member.

The container may be provided with a second bag within the first bag and around the valve member, and a third bag sealing seam which extends across the valve member and partly across the second bag between the ends of the second bag to form two parts of the second bag in communication with each other, an opening being provided through the third bag sealing seam within the region of the valve member, said two bags containing substances to be mixed together.

In order to produce such containers in accordance with the invention there is also provided an apparatus comprising first forming means for forming a first sheet into a tube to make a bag, a second forming means for forming a second sheet into a tubular valve enetered into said bag, first welding means for effecting a first sealing seam across the bag and valve to provide a seam to close one end of the container save for an opening in said first seam within the valve member, second welding means for effecting a second sealing seam across said bag and valve member to close the other end of the container, a third welding means for making a weld in the valve member in a position therein which in the finished container will lie between its ends, a rod located through said first welding means to provide said opening, and means for supplying contents into said bag.

Preferably the first and second welding means are provided close to each other and operate simultaneously to provide respectively a seam closing the completely closed end on one container and a seam providing the opened or delivery end of the adjacent container, the adjacent containers being separted by severing between the two simultaneously formed seals.

BRIEF DESCRIPTION OF DRAWINGS

The invention will now be described by way of example with reference to the accompanying drawings, in which.

DESCRIPTION OF PREFERRED EMBODIMENTS

Figure 1:
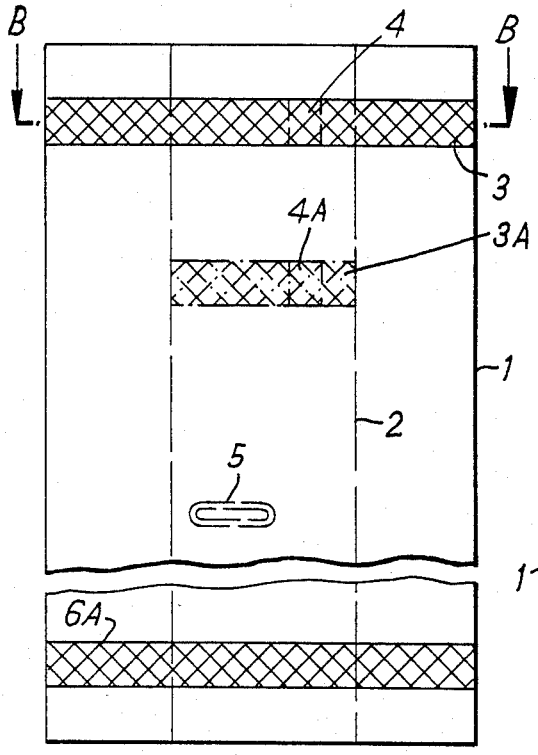
FIG. 1 shows a front view of the plastics container.
Figure 2:
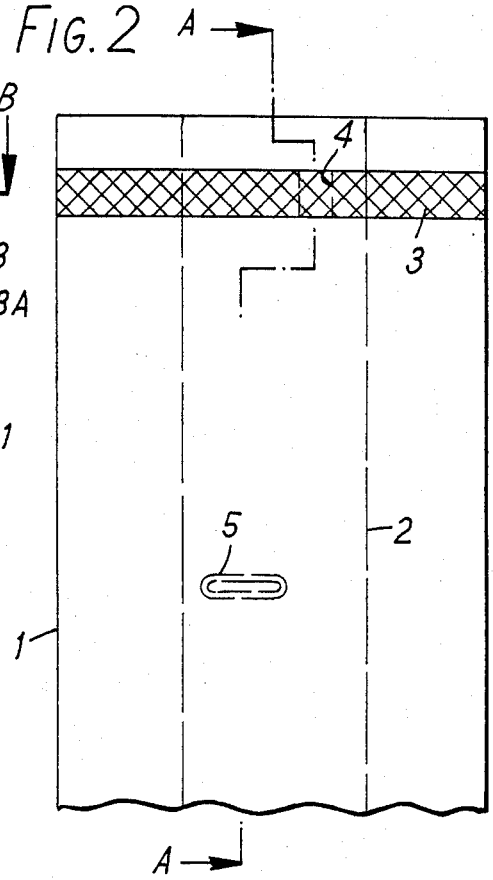
FIG. 2 is an enlarged part view showing the delivery end in detail.

The container shown in FIG. 1 is formed by an outer elongated plastics bag 1 of tubular form and an inner plastics valve member 2 also of tubular form. The adjacent ends of the bag 1 and valve member 2 at the upper end of the container are heat sealed at 3 by a first bag sealing seam through the four layers except for an opening 4 within the valve member 2.

An elongated sealed opening 5 is provided in the tubular valve member transversely thereof, passing entirely through both walls thereof. This serves as the valve member seam which serves to provide resistance for an access tube which will then pierce valve member 2 to give access to the interior of the bag 1. This valve member seal may alternatively be a straight line seal.

The lower end of the container is sealed by providing a second bag a sealing seam 6A across the lower end fusing the four layers together.

The liquid contained within the outer bag 1 preferably fills the container entirely so as to exclude air. As sealing takes place any air in the container is expelled and the liquid is maintained within the container preferbly under normal pressure, negative pressure or, if desired, under a positive pressure by a slight overfilling to effect flexing of the plastics material.

Figure 3:
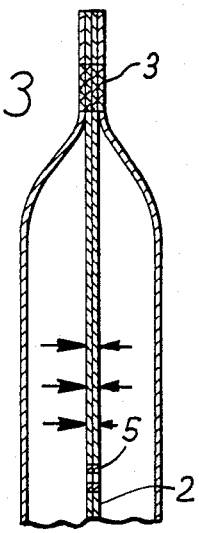
FIG. 3 is a sectional view taken along the line A—A in FIG. 2.
Figure 4:
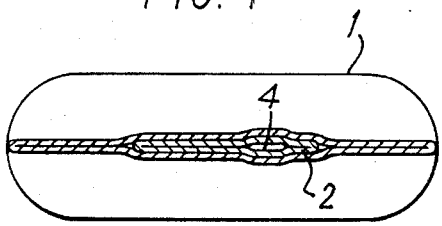
FIG. 4 is a cross-section taken along the line B—B in FIG. 1.

Closure of the valve member is effected by the pressure of the liquid acting on the valve member in the region thereof between the sealed opening 5 and the seal 3 as shown by the arrows in FIG. 3.

If desired a further sealing seam 3A (FIG. 1) may be provided across the valve member 2 between its ends leaving a gap 4A. This provides a further safety measure against any liquid oozing out after the valve member 2 has been pierced below the seal 3A. Air or liquid pressure in the bag between the seals will hold the valve member 2 flat.

The tubular valve member 2 may be of any elongated hollow form provided that the sides are collapsible to prevent escape of liquid through the valve member. It is preferred to use a low density polythene sheet having a thickness of 0.0008 to 0.0015 e.g. about 0.001" but of course any suitable thickness may be chosen for the bag or valve member provided that the strength is compatible with the contents and that the valve member can be pierced without too much difficulty.

Figure 5:
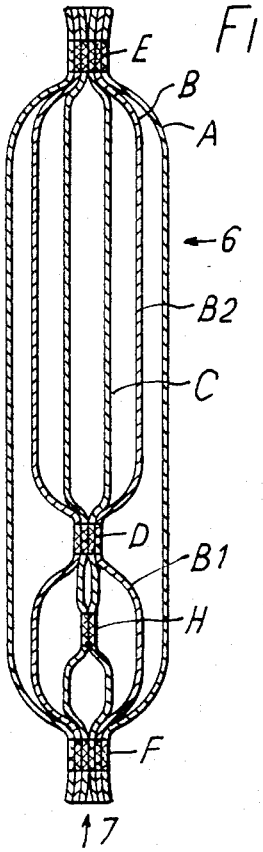
FIG. 5 is an elevational view of another form of container made in accordance with the invention.
Figure 6:
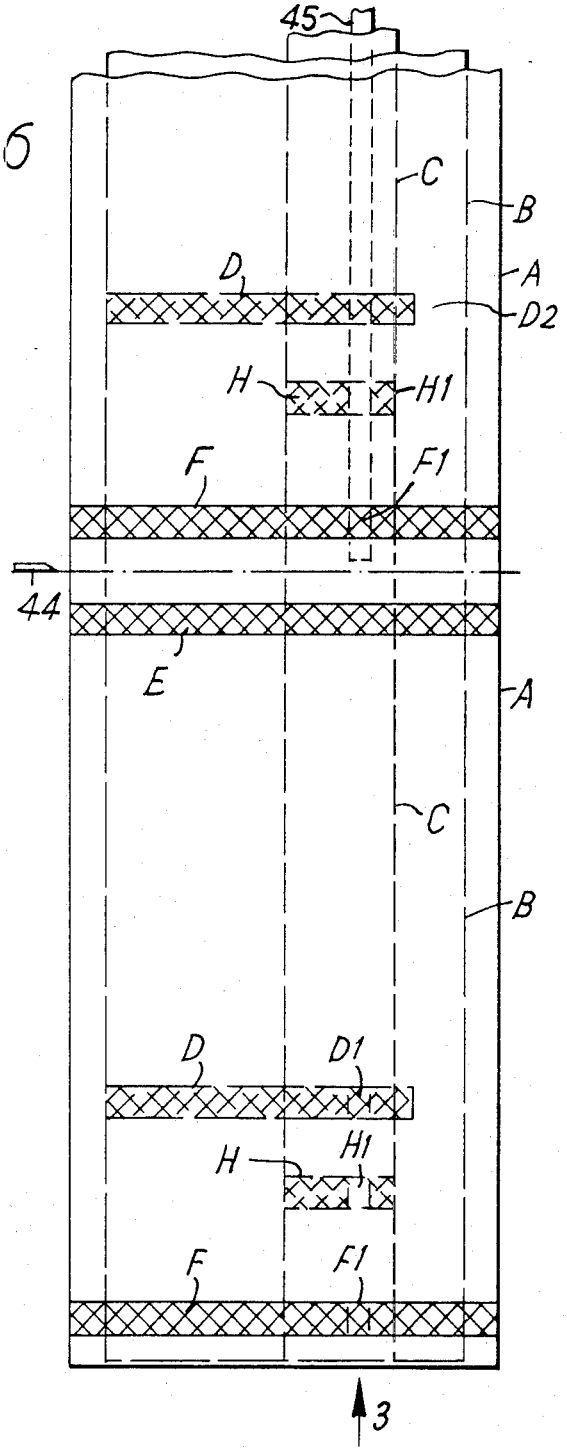
FIG. 6 is a view of the container in the direction of the arrow 6 on FIG. 5 with an unfinished (empty) container above it.

FIGS. 5 and 6 show a container having a second bag within the outer bag. The containers in these Figures are shown in the position in which the containers are made in the machine of FIGS. 13–16 i.e. the bottom of the container is shown uppermost.

The finished container consists of an outer tubular bag A, an inner tubular bag B, and a tubular valve member C. The member C is shown inflated only for clarity of drawing but normally it will be flattened by the pressure of liquid in the bag B. The member C extends completely through the bag B and the bag B extends completely through the bag A. The bag together with the member C has a third transverse bag sealing seam D which seals four layers together and extends across the member C but only partly across the bag B so as to leave a gap D2 (FIG. 6) whereby that the upper and lower portions B1, B2 of the bag B are in communication with each other. The bottom of the container has a second transverse seal E which seals six layers together and which extends completely across the bag A and closes the bags A,B and member C. A first transverse seal F extends completely across the bag A and seals six layers together including the bag B and member C. A further valve member transverse seal H extends across the valve member C only. The seals F,H and D have gaps F1,H1 and D1 extending centrally therethrough. Instead of the fourth seal, a slit or weakened area may be provided in the member C.

In order to mix the contents of bags A and B, a stylus is introduced through the gap F1 and through the seal H. The stylus is then pierced through the seam D, to the stylus to ensure that the stylus does not merely move ineffectively through the valve member C without piercing the inner bag B.

The bags A,B and valve member C may be all made of the same material e.g. polythene sheet having a thickness of 0.0008 to 0.0015 e.g. about 0.001, inch.

Figure 8:
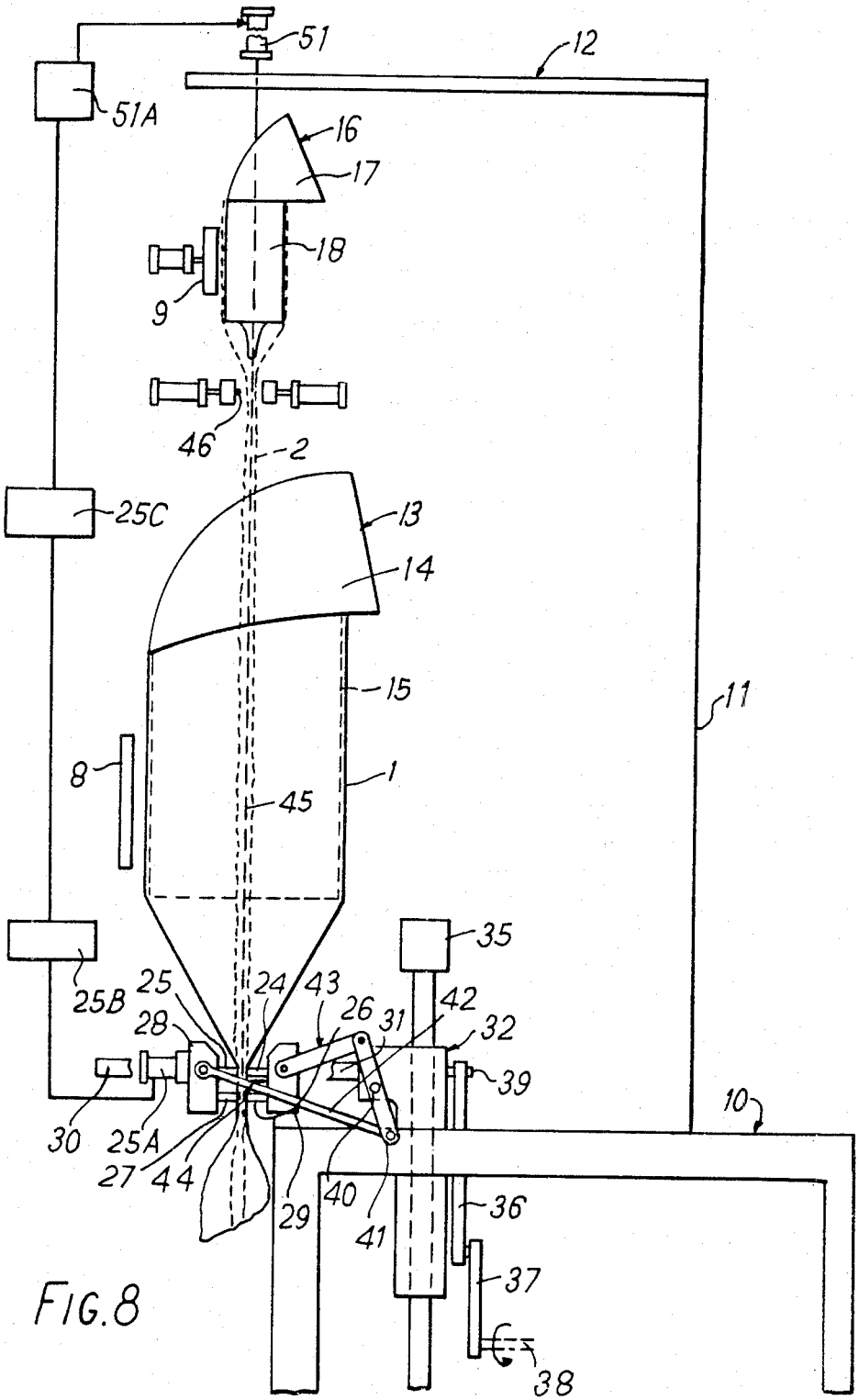
FIG. 8 is a schematic side view of a machine for producing and filling the container of FIGS. 1 to 4.
Figure 9:
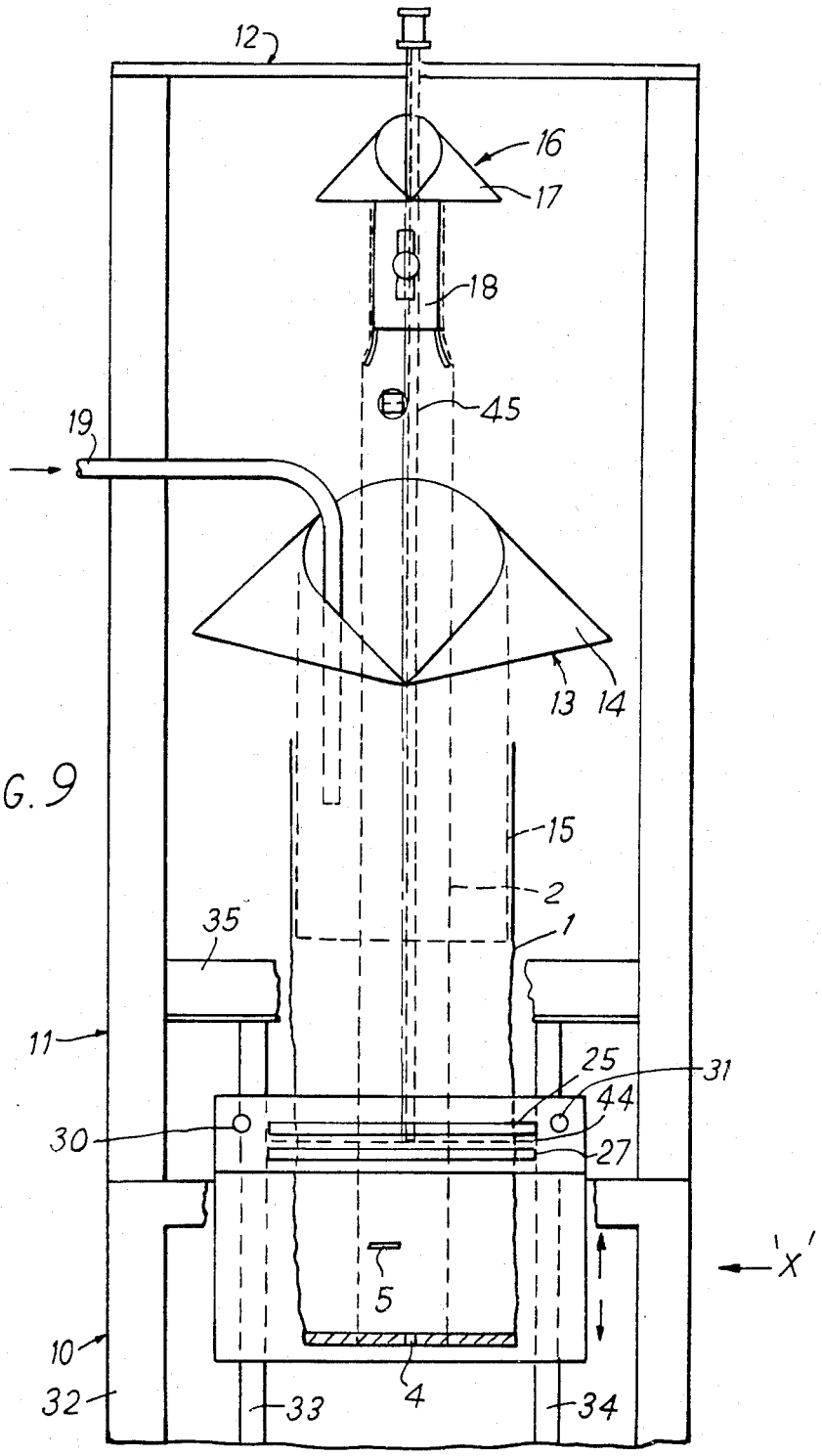
FIG. 9 is a front elevation of the arrangement shown in FIG. 8.
Figure 10:
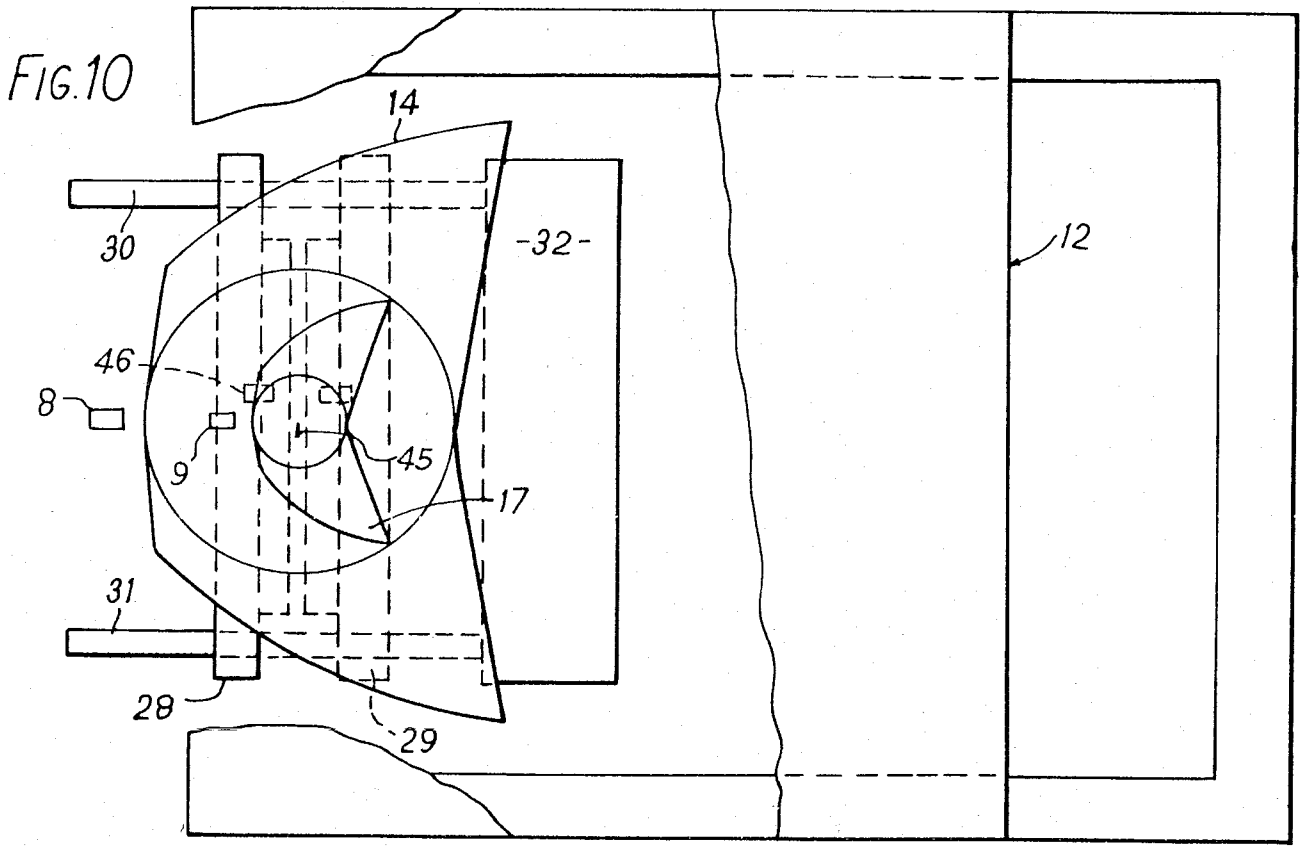
FIG. 10 is a plan view of the machine with the top plate shown cut-away.

The machine for carrying out simultaneous production and filling of the plastic containers of FIGS. 1 to 4 is shown schematically in FIGS. 8,9 and 10. Various parts necessary for the working of the machine have not been shown or described since these are well known from the prior art. The present invention is based on a modification of a packaging machine known as a vertical form fill and sealing machine.

The machine is provided with a box-like frame 10 having side frames 11 attached thereto which carry a top plate 12. The side frames 11 carry a first tube forming device 13 which shapes sheet plastics material into the outer bags. The forming device 13 comprises a collar 14 of frusto-conical shape mounted at the top of a tube 15.

A second bag valve member forming device 16 of similar construction to the first device 13, but smaller, and having a collar 17, and a tube 18, is supported by said side frames 11 in a position whereby the tube 18 enters the collar 14 and the tube 15 of the device 13 eccentrically of the tube 15.

The tubes are heat fusion sealed by usual means 8,9.

Also located within the tube 15 is a feed pipe 19 (FIG. 9) leading from a pump (not shown) which supplies the liquid to be packed in measured quantities. The delivery end of the feed pipe 19 lies on a transverse diametrical plane of the tube 18 and is offset from the axis thereof (see FIG. 9). Means are provided, but not shown, which control the liquid delivery at regular intervals in synchronism with the formation of the bags.

The bags are sealed by sealing devices of known normal construction comprising two pairs of bars 24, 25 and 26, 27 mounted on bars 28, 29 capable of reciprocation along rods 30, 31 forming part of a carriage 32. The carriage 32 is slidably mounted on vertical rods 33, 34 (FIG. 9) supported in the frame 10 and by a cross-bar 35 extending between the two side frames, and is capable of reciprocation by a linkage system 36, 37 (FIG. 8)

driven by a shaft 38 from a motor (not shown). The carriage 32 contains gear mechanism (not shown) for translating an oscillatory rotary motion of an input shaft 39 into an oscillatory rotary motion of an output shaft 40 having an axis disposed at 90° to the input shaft 39. The output shaft 40 carries an operating arm 41 having its respective ends pivotally connected to two links 42, 43 in turn respectively pivotally connected to the bars 28, 29 which support the sealer bars 24–27. It will be seen that the rotation of the shaft 38 will cause the link 36 to reciprocate the carriage in an up and down movement whilst at the same time imparting an oscillatory drive to the shaft 39. The operating arm 41 and links 42, 43 are so arranged that the bars reciprocate towards each other as the carriage descends and away from each other as it ascends.

The sealer bar 25 is reciprocable by a pneumatic cylinder 25A controlled by a valve device 25B and timing device 25C.

Depending from the top plate 12 is a steel rod or strip 45 e.g. a flat strip of steel coated with polytetrafluorethylene which passes through the tube 18 and is disposed to one side of the centre. The lower end of the strip is positioned between the upper rear and front sealer bars 24, 25 when the latter are at the uppermost extent of their path of reciprocation. The rod 15 may be about four or five thousands of an inch overall thickness.

A knife 44 is provided on the sealing arm 28 and serves to sever the successively formed and filled containers.

At a position between the tube 18 and the collar 14 there is provided hot wire sealing elements 46 capable of reciprocation towards and away from the valve tube in order to form a seam which may be sealed openings 5 or a straight seam 3A, which may be about two thirds to three quarters of the width of the inner valve tube. The sealing element 46 is reciprocated by means driven synchronously with the drive of the carriage 32 by usual known means.

The rod 45 is carried by a piston in a double acting cylinder 51 operated in timed relation with the movements of the carriage 32 through a valve device 51A, and the timing device 25C.

Additional clamps 80 of known construction are provided on the bars 28, 29 for clamping the bags and these may be grooved so as not to hold the rod 45.

Air and/or water cooling means will be provided for cooling the seams and elements 24,25, 26,27.

The operation of the machine is as follows:

Plastic sheeting is fed to the two tube forming devices 13, 16 and the resulting tubes seam welded by vertical seams as they pass down the exteriors of the respective tubes 15, 18. The tubes, disposed one within the other, pass between the two bars 28, 29 of the ends sealing device which is shown at the upper end of its stroke in the closed position. In this position the bag is clamped by the clamps 80 and the sealing bars 24 and 27. Immediately after the clamps and sealing bars have come together, the sealing elements are briefly energised by way of circuitry and timing mechanism (not shown) operated in synchronism with the carriage drive. The sealing element 46 is also operated to form a transverse sealing opening in a similarly timed manner. A pair of seams is formed by the sealing bars 24, 25 and 26, 27 and the tubes severed between the two tubes by the knife 44. In the upper seal so formed an aperture is left within the smaller tube due to the intervention of the steel strip 45.

After the outer tube is filled by way of the pipe 19, the sealing device moves downwards to draw the now sealed two tubes over their respective former tubes 15, 18.

As the sealing device moves downwards the cylinder 51 operates to urge the rod 45 downwards because at this time it is still clamped by the bars 24 to 27. Part way of the down stroke the bar 25 is retracted by the piston and cylinder 25A and the cylinder 51 operates to raise the rod 45 to its starting position.

Continued downward movement brings the carriage 32 to its lower most position of its stroke where the bars 28, 29 are moved apart to a distance whereby they can clear the filled container as they travel upwards to the upper end of the carriage stroke. Return to the upper end results in closing of the bars 28, 29 whereby the tube is compressed, and simultaneously sealed, in such a manner that the liquid within the container is placed under a slight positive pressure. It will be appreciated that as the lower sealing bars 26, 27 effect sealing of the upper end of one container to close the latter the sealing bars 24, 25 effect sealing of the lower end of the succeeding container.

If desired the sealing means 46 may be arranged between the tube 15 and the bars 24 to 27 and the rod 45 can be raised above the sealing means 46 so that the valve tube seal can extend completely across the valve tube.

If necessary a third pair of sealing elements may be disposed above the level of the knife 44 and between the sealing bars 24, 25 and 26, 27 to effect a third seam in the form of a tear-off or removable strip. Each container will therefore be provided at one end with one seam having the aperture through which the access tube will be inserted and another seal to ensure that the end is completely sealed when used to contain milk or orange juice.

The resulting containers facilitate transportation, are cheap to produce and in certain applications are re-sealable.

The re-sealable quality provides the possibility of re-using the container in certain circumstances and may be used as a balloon by inflating the container with the straw after drinking the contents, or even as a pillow if large enough.

For use with containers having a capacity of say 1–20 liters where it is not intended that the entire contents of the container be discharged at one time, it is desirable to provide an adaptor having a tap by means of which quantities of the contained liquid may be dispensed.

Figure 7:
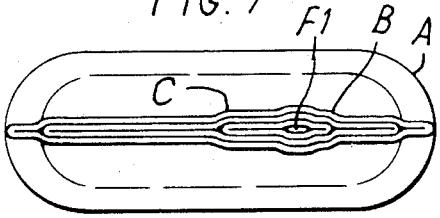
FIG. 7 is a view thereof in the direction of the arrow 7 on FIG. 5.

A machine for carrying out continuous production and filling of the containers of FIGS. 5 to 7 is shown in FIGS. 12 to 15. Various parts necessary for the working of the machine are omitted from the drawings and description since these are well known from prior art. The machine again is a modification of a packaging machine known as a vertical form fill and sealing machine.

The machine is provided with a box-like frame 110 having side frames 111 attached thereto which carry a top plate 112.

The side frames carry a first tube forming device 146 which shapes a first plastics sheet into a tube from which the valve members C are made.

Below the device is a second similar but larger forming device 153 for making a tube from which the bags B are made and below this is a third similar and larger forming device 113 for making a tube from which the outer bags A are made.

The devices 146,153,113 include a collar 146A,153A,114A respectively of frusto-conical shape mounted at the upper ends of tubes 147,154, 115. These forming devices are associated with vertical seam sealing means 148,155,157 respectively.

Feed pipes and pumps (not shown) are provided for filling the outer and inner bags, and means which control the supply of the two substances at regular intervals in synchronism with the formation of the containers.

The containers are sealed transversely by four sets of sealing elements 152;156;124,125,126,127. These form the seals H,D,F,E, (FIG. 6) respectively. The containers are made in upside down positions so that 124,125 form the seal F of one container while 126,127 are forming the finishing seal E of the adjacent lower container.

Each transverse sealing device comprises a pair of sealing elements which are reciprocated at appropriate intervals. Thus the sealer bars 124, 125 and 126,127 are mounted on bars 128, 129 capable of reciprocation along rods 130,131 forming part of a carriage 132, all as previously described. Clamping bars such as 80 in FIG. 10 will also be provided.

The carriage 132 is slidably mounted on vertical rods 133,134 supported in the frame 110 and by a cross-bar 135 extending between the two side frames, and is capable of reciprocation by a linkage system 136,137 driven by a shaft 138 from a motor (not shown).

The carriage 132 contains gear mechanism (not shown) for translating an oscillatory rotary motion of an output shaft 140 having an axis disposed at 90° to the input shaft 139. The output shaft 140 carries an operating arm 141 having its respective ends pivotally connected to two links 142,143 in turn respectively pivotally connected to the bars 128,129 which support the sealer bars 124–127. It will be seen that the rotation of the shaft 138 will cause the link 136 to reciprocate the carriage in an up and down movement whilst at the same time imparting an oscillatory drive to the shaft 139. The operating arm 141 and links 142, 143 are so arranged that the bars reciprocate towards each other as the carriage descends and away from each other as it ascends. The bars 128,129 carry the usual clamps 180.

Depending from the top plate 112 is a steel rod or strip 145 which passes through the tube 118 and is disposed to one side of the centre. The lower end of the strip is positioned between the upper rear and front sealing elements 120,121 when the latter are at the uppermost extent of their path of reciprocation. The steel strip also reciprocates so that while it serves to make the gaps F1, H1 no gap is made in the seal D. Tubes 119,162 serve for filling the bags A,B. The steel strip 145 is reciprocated by valve devices and a timing device as described with reference to FIGS. 8 and 9.

A knife 144 is provided on the sealing arm 129 and serves to sever the successively formed and filled containers.

The operation of the machine is as follows:

Three plastics sheets are fed to the three tube forming devices and the resulting tubes are seam welded as they pass down the exteriors of the respective tubes 147,154,115. The plastics tubes, disposed one within the other, pass between the transverse sealing elements. Immediately after the clamps 180 and sealing elements 120,121,122,123 have come together so that they grip the tubes, the sealing elements are briefly energised by way of usual circuitry and timing mecchanism (not shown) operated in synchronism with the carriage drive. A pair of seams is formed by the sealing elements 120,121, 122, 123 and the tubes severed between the two tubes by the knife 144.

After the bags are filled the sealing devices move downwards to draw the now sealed tubes over their respective former tubes 147,154,115. The rod 145 is drawn down at the same time over part of the downstroke where the sealer bar 125 is retracted (like the sealer bar 25 with similar means) and the bar 145 is raised.

Continued downward movement brings the carriage 132 to its lowermost position of its stoke where the bars 128, 129 are moved apart to a distance whereby they can clear the filled container as they travel upwards to the upper end of the carriage stroke. Return to the upper end results in closing of the bars 128,129 whereby the tubes are compressed, and simultaneously sealed, in such a manner that the liquid within the container is placed under a slight positive pressure.

It will be appreciated that as the lower sealing elements 122,123 effect sealing of the bottom end of a container (this bottom end being uppermost of the inverted container) to close the latter, the sealing elements 120,121 effect sealing of the uppermost end of the succeeding container (which is lowermost in the inverted conainer). In the finished container the end uppermost in the machine becomes the bottom of the container and the end lower most in the machine is the upper end of the container.

In the drawings the sheets are shown in FIGS. 3,4,5 and 7 with exaggerated thickness merely for convenience of drawing.

I claim:

1. A method of making containers comprising forming a first sheet of liquid-impervious material into a first tube for successive bags, forming a second such sheet into a smaller diameter second tube for making successive tubular valve members, feeding contents into the first tube at successive intervals, locating the second tube in the first tube, providing first and second seals between successive tops and bottoms of successive containers and separating successive containers from each other, forming third seals (3A or 5) partly across each of the second tubes between the upper and lower ends of the containers, making said first and second seals (4,6A) as seals across the tubes, said first and second seals being in pairs closely adjacent to one another and parallel to each other, one of said pairs of seals making the top of one container, making openings (4) through the seals forming the tops of the containers by means of a rod inserted through these seals, while the second seal makes the bottom of the preceding container.

2. A method as claimed in claim 1, comprising introducing a third tube (B2) between the first and second tubes, filling the third tube with a liquid different from that filled into the first tube, and forming a fourth seal (D) across the second tube and part only of the third tube.

3. A method as claimed in claim 1, or 2, wherein the second tube extends for some distance out of the bag at its open end for attachment to a tap.

4. A machine for making a container comprising an inner tube of flexible material within an outer tube of flexible material, said machine comprising a first sheet guiding and tube forming means for forming a first sheet into a first vertical tube to make the outer tube, a first vertical sealing means (8) to seal the vertical edges of the outer tube together, a second sheet guiding and tube forming means located above the first sheet guiding and tube forming means for forming a second sheet in a downward direction into the inner second tube which thereby extends vertically through said outer tube, a second vertical sealing means (9) for sealing the vertical edges of the inner tube together, first and second horizontal sealing means for forming seals across the inner and outer tubes and spaced apart to form the container between them with said seals at the upper and lower ends of the container, means for feeding the tubes in successive steps for forming successive containers therefrom, third horizontal sealing means (46) for forming an intermediate seal (3A or 5) partly across the inner tube before it enters the outer tube so that it becomes located between the upper and lower seals of the container, and a flat vertical strip (45) which extends completely through both forming means and first and second sealing means thereby passing through the upper seal while the upper seal is being made so as to leave an opening in the upper seal.

Figure 11:
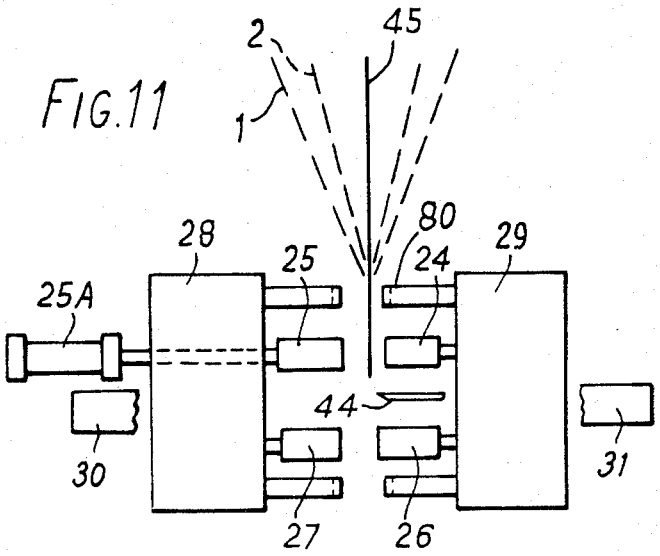
FIG. 11 is an enlarged schematic view of the components which effect sealing and cutting, FIG. 12 (12A, 12B) is a side elevational view showing the main part of a machine made in accordance with the invention for making the container of FIGS. 5 to 7, FIG. 13 (13A, 13B) is a front elevational view thereof.
Figure 15:
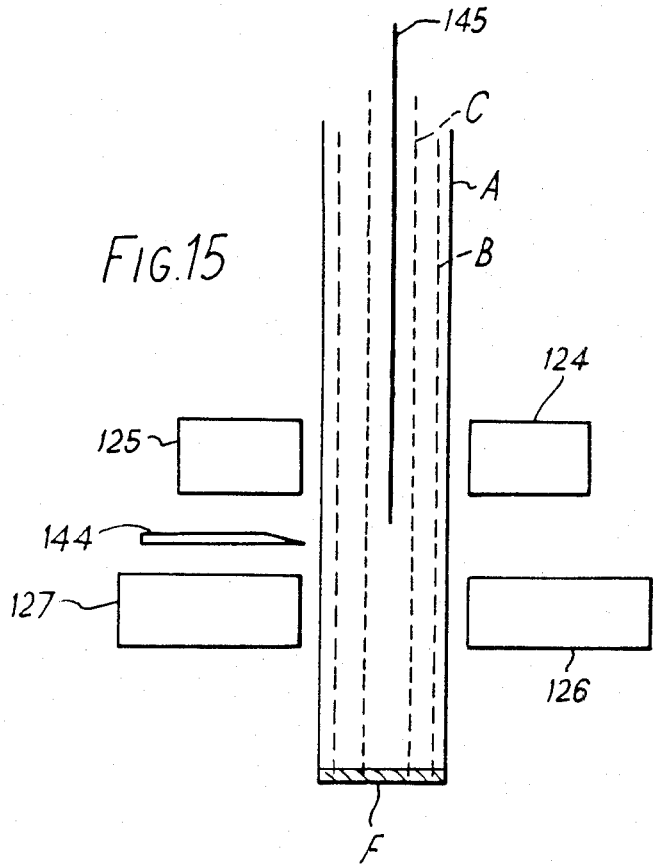
FIG. 15 is a more schematic view of a detail to be described.
Figure 12A:
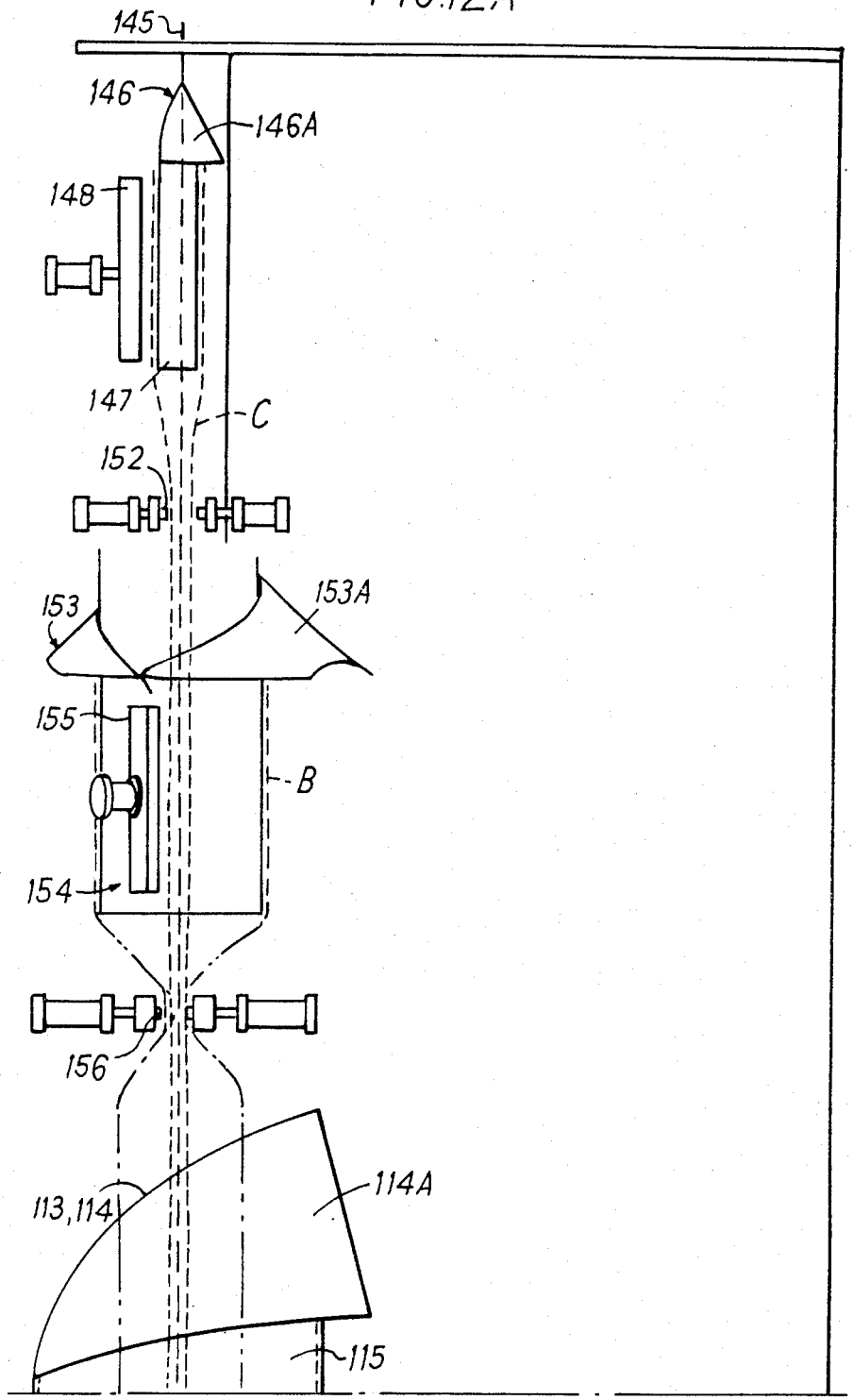
Figure 12B:
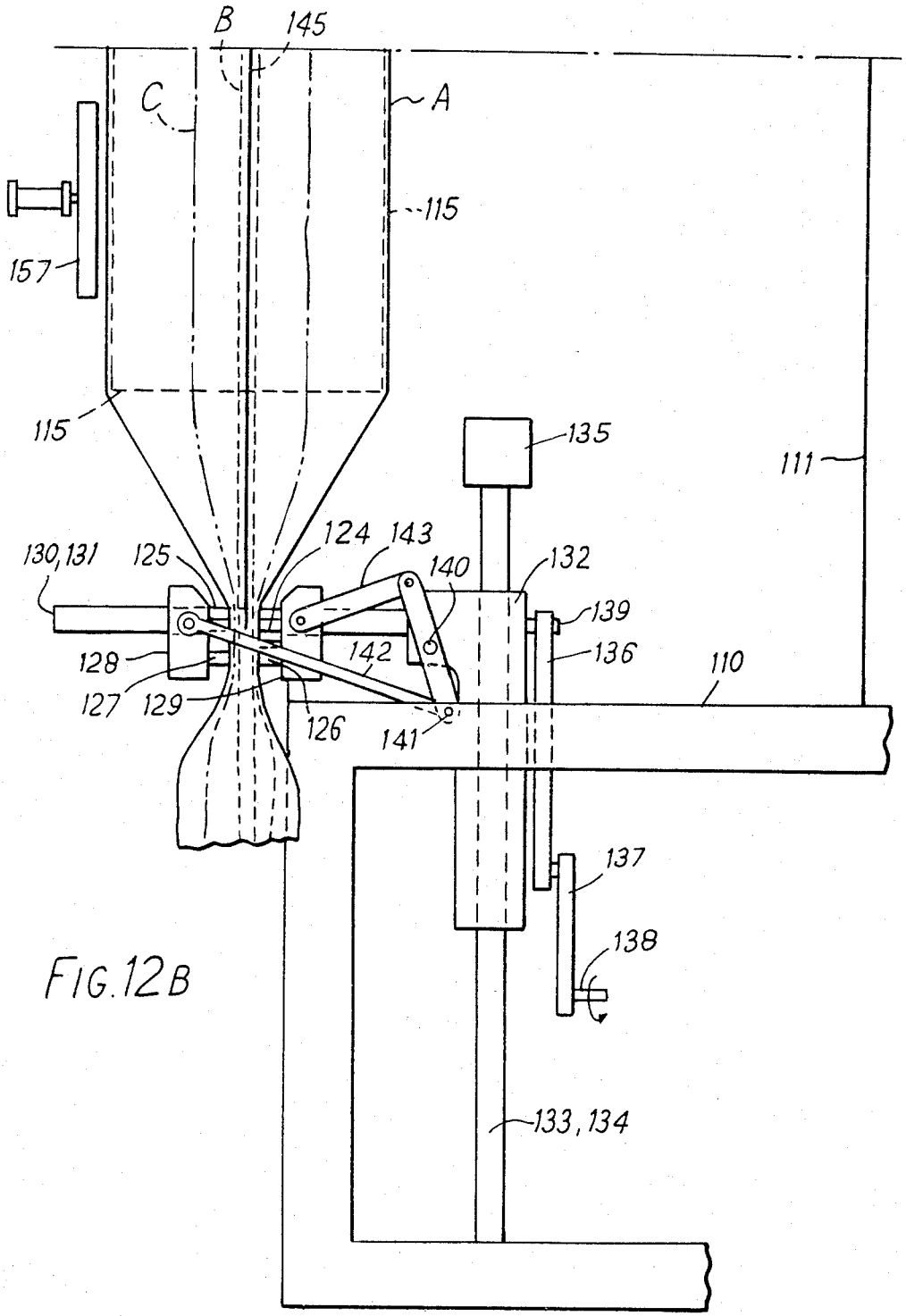
Figure 13A:
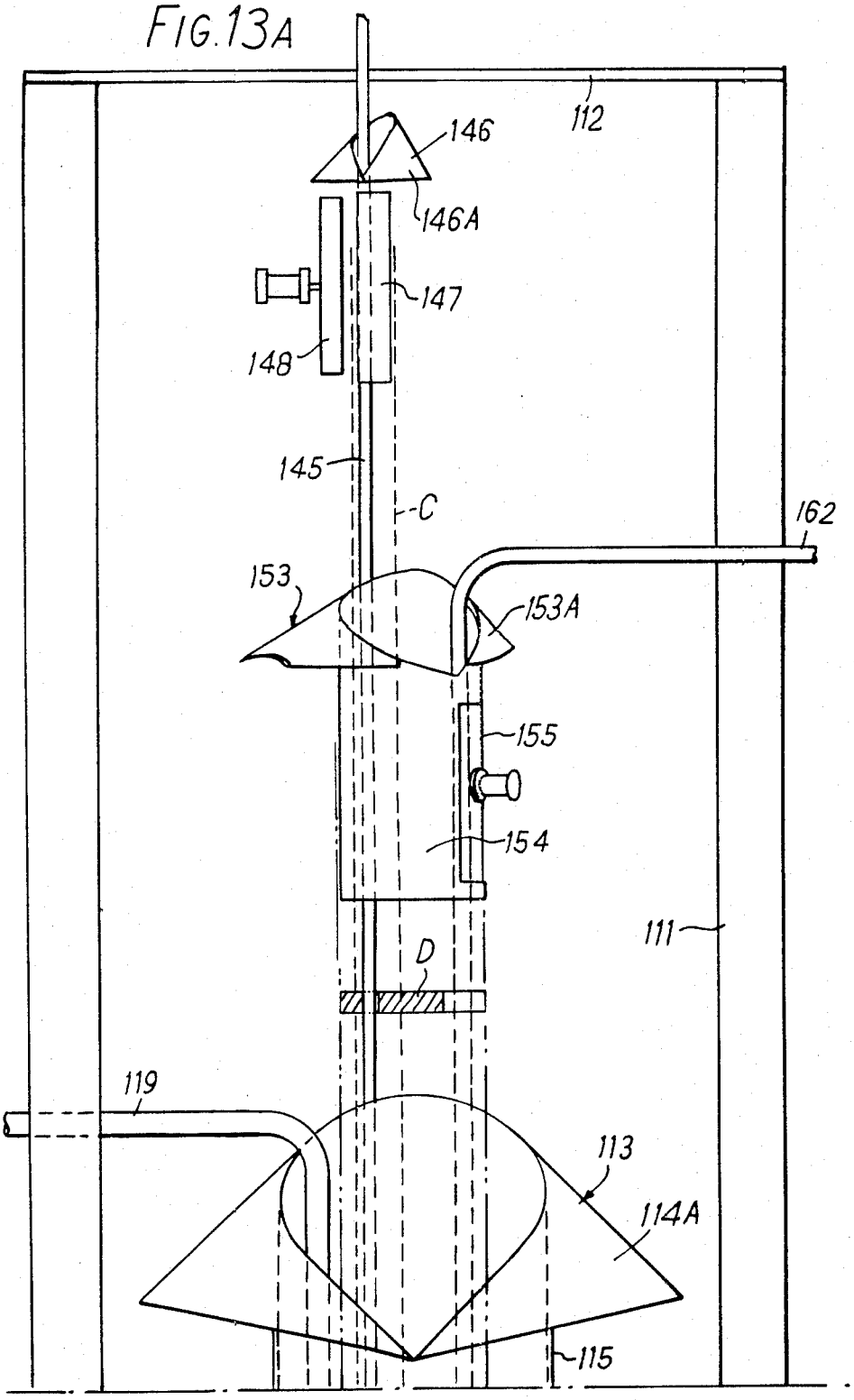
Figure 13B:
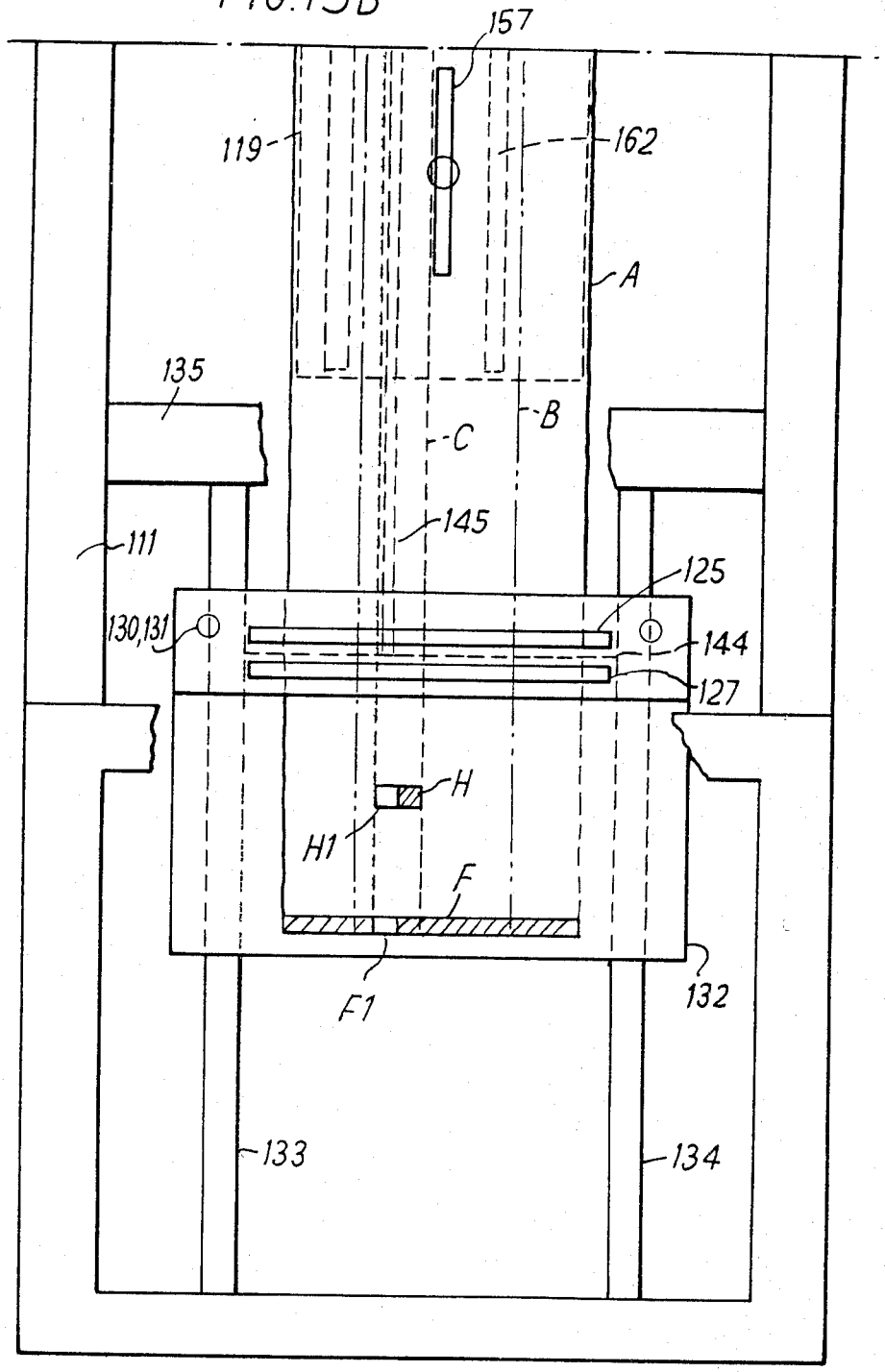
Figure 14:
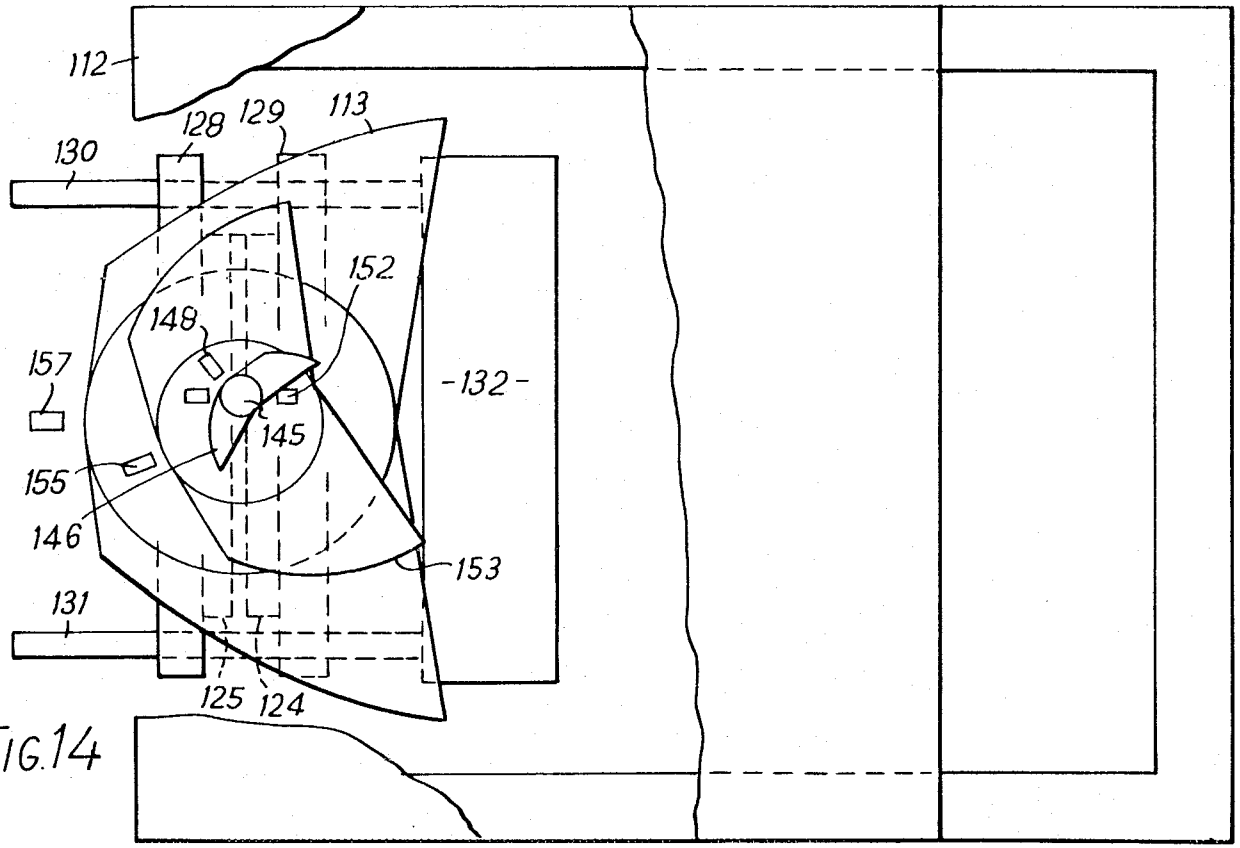
FIG. 14 is a plan view thereof.

5. A machine as claimed in claim 4 having clamps (80, FIG. 11) for clamping the tubes, two pairs of heating means (24,25,26,27) operating on both sides of the tubes to form the top and bottom seals, and means for moving the clamps and heating means simultaneously periodically to feed the tubes for making successive containers, the heating means being retracted after part of the feed stroke.

6. A machine as claimed in claim 5 wherein the clamps (80) are provided with grooves so as not to clamp on to the flat strip (45).

7. A machine as claimed in claim 4 having means for reciprocating the flat strip to follow the tubes as they are being fed.

8. A machine as claimed in claim 4 including the provision of a third tube in the container including third sheet guiding and forming means (153A, FIG. 12A) to form a third sheet into a tube to make a third tube, means to supply contents into the third tube, and a further sealing means (156) to form a further seal (D) across part of the third tube and across the second tube (2), said flat strip (45) also providing the opening in said further seal.

* * * * *